US005419509A

United States Patent [19]

Krayenhagen

[11] Patent Number: 5,419,509

[45] Date of Patent: May 30, 1995

[54] WEB TENSIONING DEVICE FOR AUTOMATIC CROSS-MACHINE TENSIONING OF CONTINUOUS WEBS

[76] Inventor: Everett D. Krayenhagen, 1717 Capri La., Richmond, Ind. 47374-1503

[21] Appl. No.: 243,149

[22] Filed: May 16, 1994

Related U.S. Application Data

[63] Continuation of Ser. No. 61,221, May 12, 1993, abandoned.

[51] Int. Cl.[6] ..... B65H 23/02

[52] U.S. Cl. ..... 242/419; 226/21; 226/24

[58] Field of Search ..... 242/419, 419.1; 226/15, 226/18, 21, 24, 194

[56] References Cited

U.S. PATENT DOCUMENTS

| | | | |
|---|---|---|---|
| 2,940,752 | 6/1960 | Deeker | 242/76 |
| 2,989,265 | 6/1961 | Selsted | 242/76 |
| 3,380,637 | 4/1968 | Knapp | 226/21 |
| 3,424,397 | 1/1969 | Kennedy | 242/76 |
| 3,583,615 | 6/1971 | Ott, Jr. | 226/20 |
| 5,074,450 | 12/1991 | Lindner et al. | 226/21 |

FOREIGN PATENT DOCUMENTS 723037 12/1965 Canada .

*Primary Examiner*—Daniel P. Stodola
*Assistant Examiner*—John P. Darling
*Attorney, Agent, or Firm*—Woodard, Emhardt, Naughton, Moriarty & McNett

[57] ABSTRACT

A web tensioning control device includes a cylindrical roller that automatically adjusts its orientation in order to equalize the tension across a moving web. Each end of the cylindrical roller is supported by a pneumatic spring. A conduit connects the two pneumatic springs so that pressurized air can shift between the springs in response to changes in the tension across the moving web. Thus, the cylindrical roller is allowed to pivot about an axis perpendicular to its roll axle so that the tension at each point across the moving web is substantially equal after encountering the roller.

12 Claims, 4 Drawing Sheets

WEB TENSIONING DEVICE FOR AUTOMATIC CROSS-MACHINE TENSIONING OF CONTINUOUS WEBS

This application is a continuation of application Ser. No. 08/061,221, filed May 12, 1993, now abandoned.

BACKGROUND OF THE INVENTION

The present invention relates to a web tensioning roller for use in the manufacture of and use of continuous web substrates, and in particular, to such a device that automatically adjusts its orientation to equalize the tension across a moving web.

In the manufacture or combining processes of metallic, plastic, woven, non-woven, paper, and webs of other substances, the web substrate must contact idler rolls to be positioned within the manufacturing process. If the tension exerted by the web substrate on one end of the idler roll is greater than the tension exerted on the other end of the same idler roll, a variety of problems result that affect substrates in different ways.

The causes that contribute to uneven tension may be inherent to the web substrate itself as having occurred during its formation, or the uneven tension may be mechanically induced by machine misalignments. The result of poor tension control is a finished product of lower or unacceptable quality. The finished product may be stretched, warped, or be subjected to nonuniform application of a variety of coatings and adhesives. Stretching generally deforms the substrate permanently and may render it useless as a finished product.

Warp is most common in paper products and is a result of uneven tension across a web experienced during the heating application. This uneven heat application causes more moisture to be evacuated from one side of the web than the other. The result is that one side of the web will shrink more than the opposite side and cause a curve to occur at the combining process. If the proximity of the substrate to laminating, adhesive, printing, and other coating applications is not maintained the application will be uneven and result in an inferior finished product. One way to avoid this is by controlling tension across the web to insure that the substrate maintains a uniform distance to or tension against the application.

By controlling the tension across the width of a substrate the web will be less susceptible to weaving. Weaving in continuous webs or belts is caused by the substrate attempting to pull to the high tension side during machinery operation and is most common during equipment speed changes. By effectively equalizing the tension across the web this condition is nullified. This control also expands the application of this device to assist in maintaining control over the direction of travel of belting and other like conveyance methods.

What is needed is a web tension control device that automatically equalizes the tension across a web during the manufacturing process.

SUMMARY OF THE INVENTION

A web tensioning control device for providing tension to a moving web comprises a roller disposed in contact with the web. Each end of the roller is attached to and supported by a fluid spring having an expandable cavity at least partially filled with a fluid. A conduit extends between the expandable cavities of each of the fluid springs so that fluid can shift between the first fluid spring and the second fluid spring in response to changes in the tension across the moving web. If the web has a nonuniform tension across its width before it encounters the web tensioning device of the present invention, the roller automatically reorients itself so that the tension in the web downstream from the roller is uniform across the width of the web.

One object of the present invention is to improve the manufacture of combined web substrates.

Another object of the present invention is to provide a device that automatically equalizes the tension across a moving web.

Still another object of the present invention is to provide an improved web tensioning device.

Other objects and advantages of the present invention will be apparent from the following description.

DESCRIPTION OF THE PREFERRED EMBODIMENT

Figure 1:
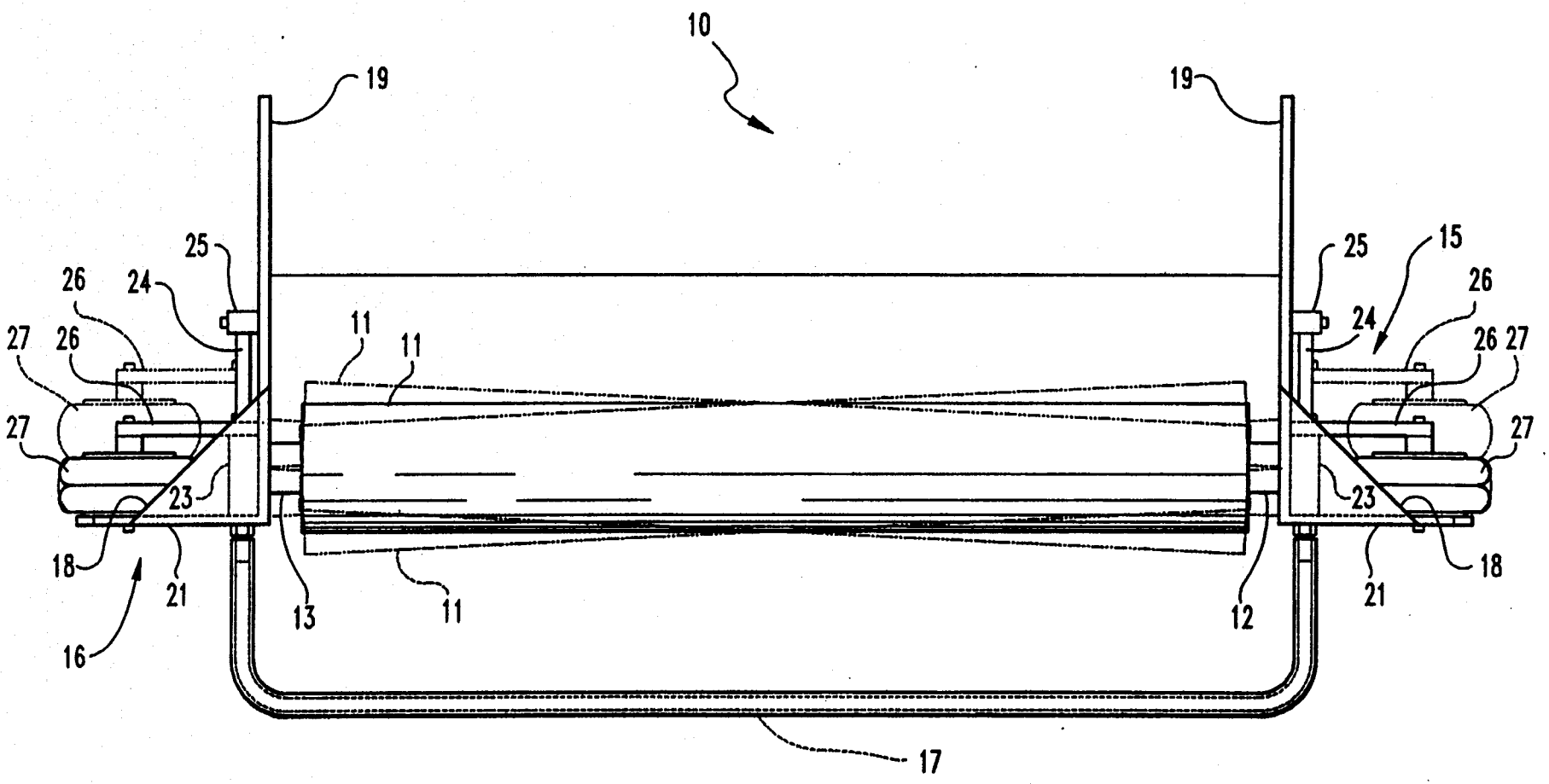
FIG. 1 is a front elevational view of a web tensioning device according to the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, a web tensioning device 10 according to the preferred embodiment of the present invention includes a cylindrical roller 11 supported by a pair of pneumatic spring assemblies 15 and 16. Like numbers are used to identify the various features of the pneumatic spring assemblies as they are substantially identical. A conduit 17 connects pneumatic spring assembly 15 to pneumatic spring assembly 16 so that air can freely shift between the two assemblies. This feature of the present invention permits cylindrical roller 11 to pivot away from its normal horizontal position, as shown in shadow, in response to a nonuniform distribution of force across the length of roller 11. In other words, roller 11 rides on a cushion of air that allows it to freely pivot through small angles about a central axis perpendicular to the roller in such a way that the center of the roller stays at the same height despite up and down movement of the ends of the roller. This pivoting capability of roller 11 is shown greatly exaggerated; in practice, the amount of pivoting necessary to equalize the tension across a web is barely perceptible by the human eye. Air spring assemblies 15 and 16 are built about a frame 18 having a vertical mounting portion 19 welded via a corner brace to a horizontal support platform 21. Frame 18 is preferably formed from quarter inch thick steel plate. Each of the ends 12 and 13 of cylindrical roller 11 are attached to and supported by a bearing member 23. Each bearing member is slidably mounted on a pair of vertical guide rods 24, one of the pair being hidden from view in FIG. 1. Guide rods 24 are suspended from an upper shaft support 25 that is attached to one face of vertical mounting portion 19. Bearings 23 slide up and down on vertical guide rods 24 via ball-less linear bearings that are well known in the art. Bearing member 23 is attached to an air bladder actuator 27 via an actuator bar 26. Air actuators 27 are commercially available from the Firestone Corporation as model 224 air stroke actuators. The vertical height of each bearing on guide rods 24 is a function of the total downward force acting on cylindrical roller 11 versus the amount of air pressure in air actuators 27.

Air actuators 27 combined with conduit 17 essentially define a sealed air chamber that supports cylindrical roller 11 against any downward forces applied thereto. In order to maintain the ends 12 and 13 of cylindrical roller 11 at a median point between the ends of vertical guide rods 24, a balance between the air pressure in air actuators 27 must be maintained with respect to the downward force acting on roller 11. Because the downward force acting on roller 11 can vary greatly depending in large part upon the speed at which the web is travelling over the roller, some means is needed to adjust the air pressure within air actuators 27 and conduit 17 to keep bearing members 23 situated between the end stops of guide rods 24.

Figure 2:
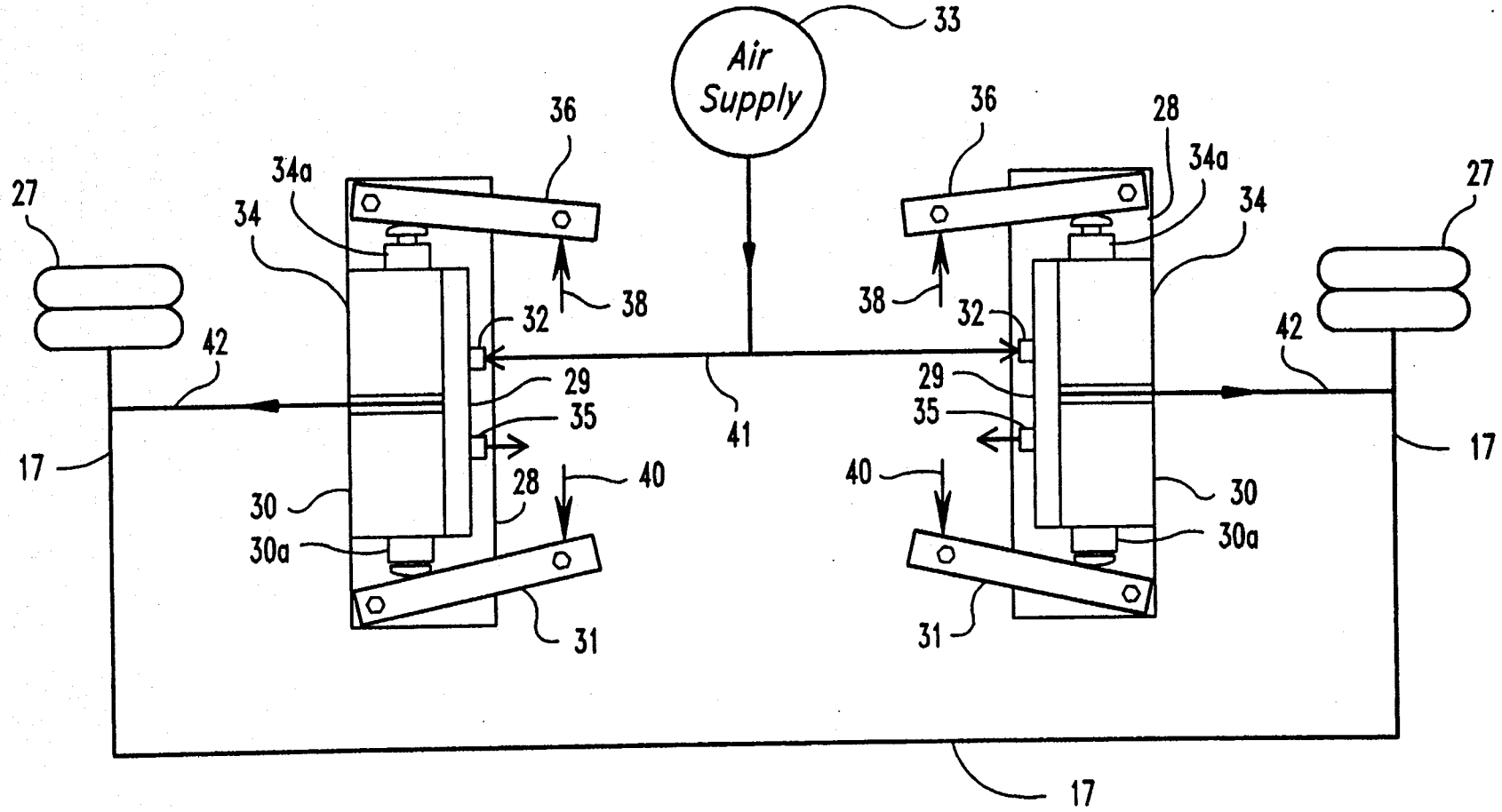
FIG. 2 is a diagrammatic illustration of the pneumatic system according to one aspect of the present invention.
Figure 3:
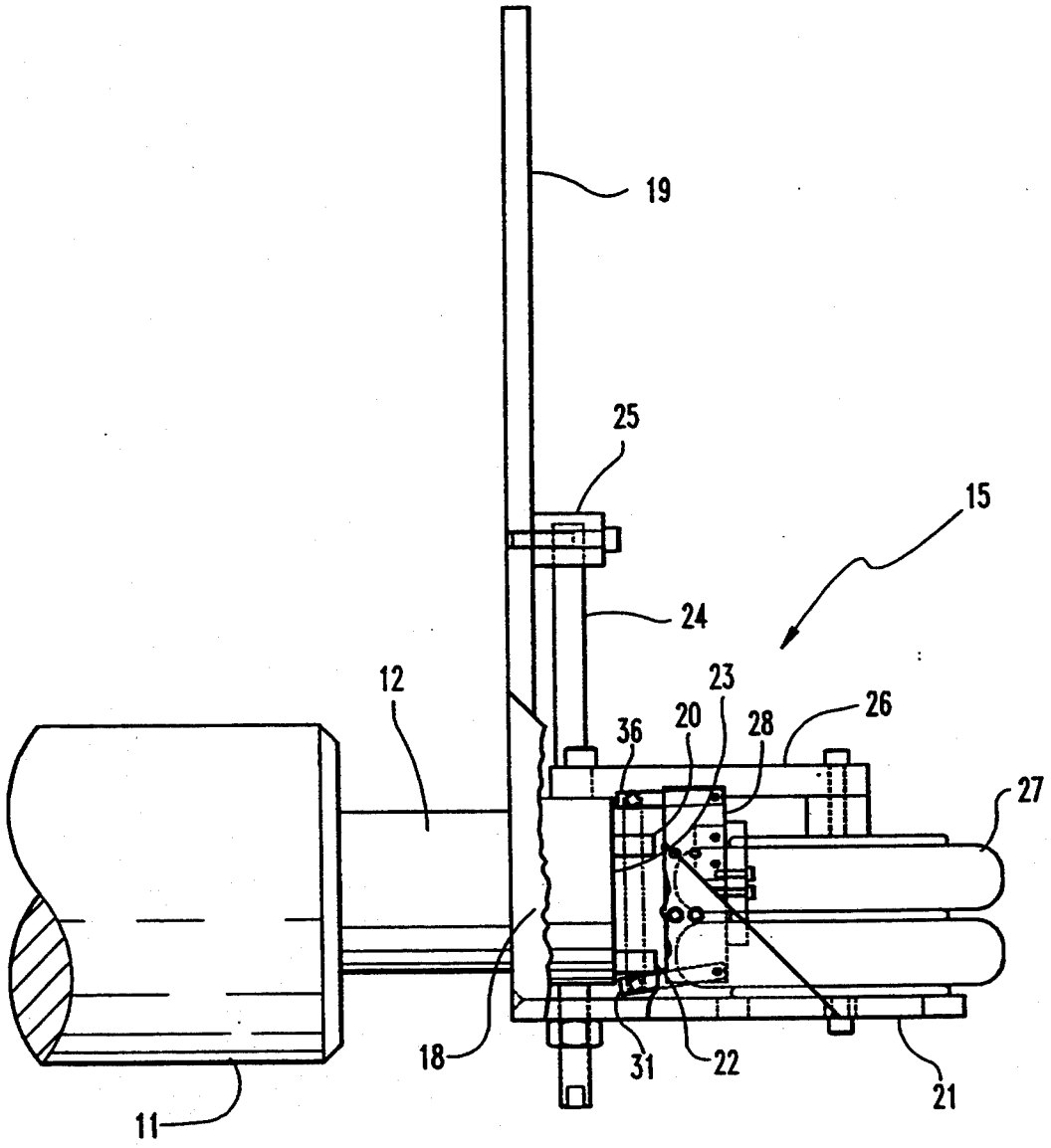
FIG. 3 is an enlarged partial side elevational view of a pneumatic spring according to another aspect of the present invention.

Referring to FIG. 2, a schematic diagram illustrating the pneumatic control system for the present invention is illustrated. As shown with respect to FIG. 1, air actuators 27 are in fluid communication with one another via conduit 17. Also, each air actuator 27 is connected to a pressurized air supply port 32 and a vent port 35 via a manifold 29 venting ports 35 open to the atmosphere, whereas supply ports 32 are connected to a pressurized gas source 33 via a supply conduit 41. Each manifold 29 is attached to a vent valve 34 and a supply valve 30. Supply valve 30 opens supply port 32 to conduit 42 when supply valve trip arm 31 is moved in the direction of arrow 40 away from supply valve actuator 30*a*. Vent valve 34 opens vent port 35 to conduit 42 when vent valve trip arm 36 is moved in the direction of arrow 38 away from vent valve actuator 34*a*. Because of conduit 17, venting of air from either of the vent ports 35 results in a pressure loss in both air actuators 27. Likewise, air supplied through one of the manifolds 29 results in pressurized air being supplied to both of the air actuators. The pneumatic system shown in FIG. 2 is utilized in order to keep both air actuators 27 sufficiently inflated to support the cylindrical roller 11, yet at the same time preventing the air actuators from becoming overinflated. The control process of venting and supplying pressurized air occurs automatically because bearing members 23 include trip dogs that contact supply valve trip arms 31 and vent valve trip arms 36 when one of the air actuators 27 becomes either underinflated or overinflated, respectively.

Each manifold 29 and pair of valves 30 and 34 are secured to the corner brace that makes up a portion of frame 18 via a mounting plate 28. Valve opening arms 31 and 36 of each valve/manifold combination are oriented in the direction toward bearing members 23 so that vent trip dog 20 and supply trip dog 22 are positioned between the valve opening arms. Thus, when an air actuator 27 becomes overinflated, bearing member 23 moves upward until vent trip dog 20 comes into contact with vent valve trip arm 36 causing air to be vented from the pneumatic system so that bearing member 23 is automatically lowered to an acceptable position. Likewise, if air actuator 27 becomes underinflated, bearing member 23 moves downward until supply trip dog 22 comes into contact with supply valve trip arm 31, causing pressurized air to be injected into the pneumatic system to raise bearing member 23 back into an acceptable position. In practice, the pneumatic vent and supply system serves as a macro control system for automatically adjusting the roller 11 to support the force resulting from the overall tension in the moving web, whereas the ability of the air actuators 27 to share pressurized air via conduit 17 serves as a micro adjustment for automatically equalizing the tension across the web.

Figure 4:
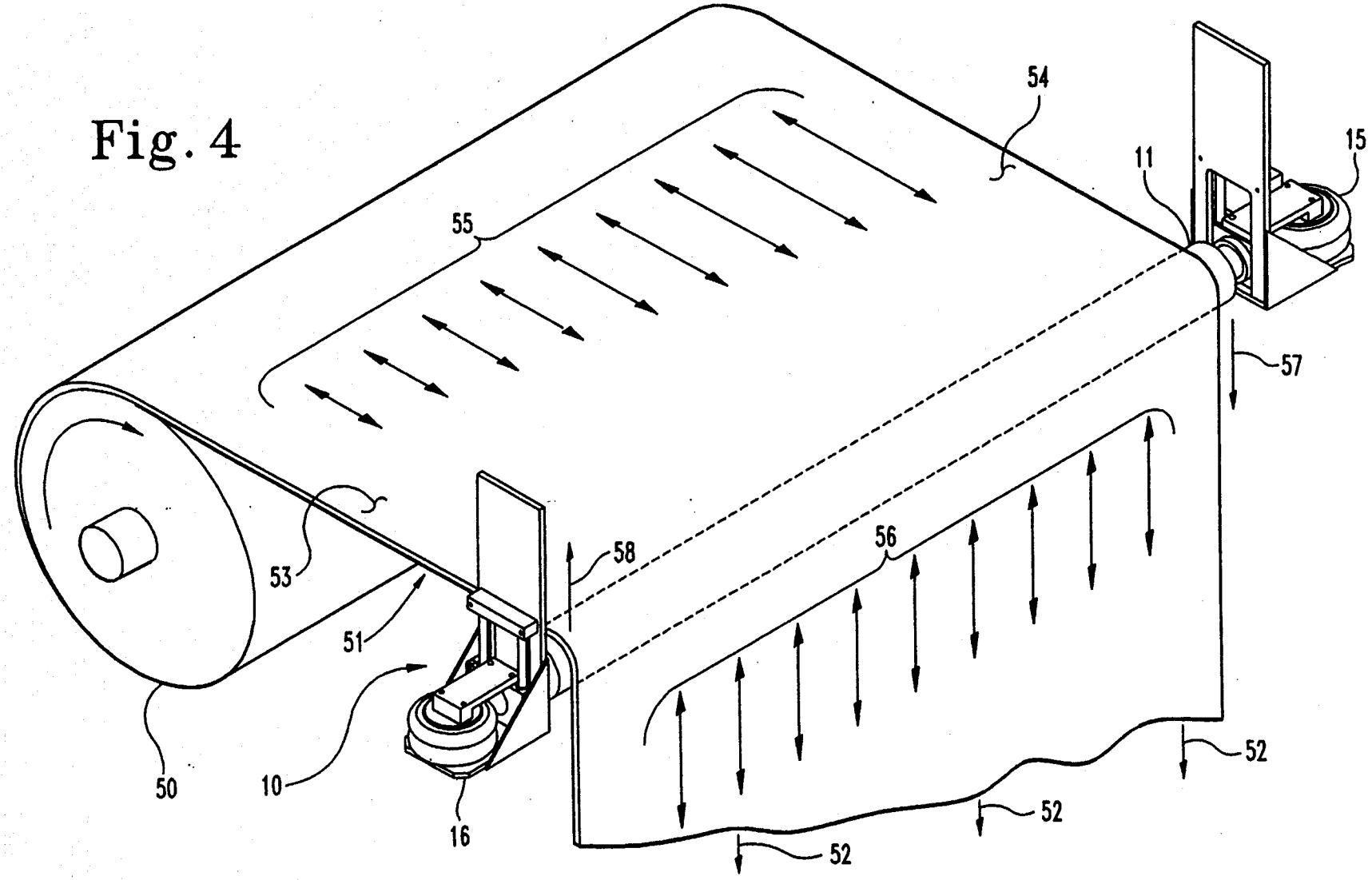
FIG. 4 is a isometric view of a web tensioning device according to the present invention in contact with a moving web.

FIG. 4 is useful in illustrating how the web tensioning device 10 of the present invention equalizes tension across a moving web in the manufacture of corrugated cardboard. It, of course, being understood that the present invention can be used to improve any manufacturing process utilizing a moving web. In the illustrated example, a paper web 51 is played out from a supply role 50 over roller 11 and down into an apparatus for making corrugated cardboard (not shown) at a velocity in the direction of arrows 52. Before encountering role 11, paper web 51 has a tension distribution 55 that increases from the left side 53 to the right side 54. Thus, if roller 11 were left unadjusted, paper web 51 would exert a stronger force at right side 54 because of the increased tension whereas left side 53 would be relatively looser against roller 11 because of the lower tension. Web tensioning device 10 responds to this situation by allowing air to flow from air spring 15 to air spring 16 such that cylindrical roller 11 assumes a new equilibrium orientation. The right side is lowered in the direction of arrow 57 whereas the left side of roller 11 is raised in the direction of arrow 58. This readjustment is normally on the order of a fraction of a degree and is therefore not readily perceptible by the human eye. However, this slight reorientation of cylindrical roller 11 results in the tension in the paper web 51 being uniformly redistributed so that the tension 56 at all points across the width of the web is equalized. The end result is less warping, and therefore less waste, in the manufacture of corrugated cardboard.

While the invention has been illustrated and described in detail in the drawings and foregoing description, the same is to be considered as illustrative and not restrictive in character. For instance, those skilled in the art will appreciate that fluid springs utilizing using an incompressible fluid such as water could be substituted for the pneumatic springs described without departing from the present invention. It being understood that only the preferred embodiment has been shown and described and that all changes and modifications that come within the spirit of the invention are desired to be protected.

What is claimed is:

1. A web tensioning device for providing tension to a moving web, said device comprising:

an idler roller disposed in contact with the web, said roller having first and second ends;

air spring means attached to said roller for urging said roller into said web and providing a predetermined distributed force to the web while enabling said roller to rotate about its rotational axis;

means for supplying pressurized air to said air spring means wherein said means for supplying includes a mechanical actuator contacted by said air spring means when the pressure of said web against said roller results in compression of said air spring means to a predetermined low limit; and means for venting pressurized air from said air spring means, said means for venting releasing pressurized air from said air spring means when said roller is disposed toward the web by said air spring means in excess of a predetermined high limit, said air spring means including a bracket having two receptacles wherein the first and second ends of said roller are rotatably retained therein, and an air stroke actuator attached to said bracket and pneumatically connected to said means for supplying and said means for venting, said mechanical actuator being attached to said bracket.

2. The device of claim 1 including a linear bearing attached to said bracket to define a path along which said bracket moves in response to said air stroke actuator, said linear bearing also reducing friction in moving said roller to increase and decrease web tension.

3. A web tensioning device for providing tension to a moving web, the device comprising:

a roller disposed in contact with the moving web, said roller having a first end and a second end;

a first fluid spring having an expandable cavity at least partially filled with a fluid attached to and supporting said first end of said roller against the tension in the moving web;

a second fluid spring having an expandable cavity at least partially filled with said fluid attached to and supporting said second end of said roller against the tension in the moving web;

a conduit having a first end in fluid communication with said cavity of said first fluid spring and a second end in fluid communication with said cavity of said second fluid spring; and said cavity of said first fluid spring, said cavity of said second fluid spring and said conduit together define a sealed chamber, wherein said conduit permits said fluid to shift between said first fluid spring and said second fluid spring in response to changes in the tension across the web.

4. The web tensioning device of claim 3 wherein:

said fluid is a gas;

said first fluid spring is pneumatic; and said second fluid spring is pneumatic.

5. The web tensioning device of claim 4 further comprising:

a first bracket attached to said first end of said roller and said first fluid spring, said first bracket including a linear bearing substantially restricting said first end to movement along a first line in response to expansion and contraction of said first fluid spring; and a second bracket attached to said second end of said roller and said second fluid spring, said second bracket including a linear bearing substantially restricting said second end to movement along a second line substantially parallel to said first line in response to expansion and contraction of said second fluid spring.

6. The web tensioning device of claim 5 wherein said cavity of said first fluid spring, said cavity of said second fluid spring and said conduit together define a sealed chamber, and the device further comprising:

control means attached to said first and second fluid springs for supplying pressurized gas to said chamber when one of either said first end or said second end move to a predetermined low limit and for venting gas from said chamber when one of either said first end or said second end moves to a predetermined high limit.

7. The web tensioning device of claim 6 wherein:

said control means includes at least one vent valve for venting gas from said chamber and at least one supply valve positioned between a pressurized gas source and said chamber, said control means further including mechanical actuator means for opening said at least one vent valve when one of either said first end or said second end moves to said predetermined high limit and for opening said at least one supply valve when one of either said first end or said second end move to said predetermined low limit; and wherein said at least one vent valve and said at least one supply valve are biased closed.

8. The web tensioning device of claim 7 wherein:

said control means includes a first vent valve in fluid communication with said cavity of said first fluid spring, a first supply valve positioned between a pressurized gas source and said cavity of said first fluid spring, a second vent valve in fluid communication with said cavity of said second fluid spring, a second supply valve positioned between said pressurized gas source and said cavity of said second fluid spring; and said mechanical actuator means includes a valve opening arm attached to each of said first vent valve, said first supply valve, said second vent valve and said second supply valve, and includes a first low limit trip dog and a first high limit trip dog connected to and moving with said first end of said roller, and further includes a second low limit trip dog and a second high limit trip dog connected to and moving with said second end of said roller; and wherein said first low limit trip dog contacts said valve opening arm of said first supply valve when said first end moves to said low limit, said second low limit trip dog contacts said valve opening arm of said second supply valve when said second end moves to said low limit, said first high limit trip dog contacts said valve opening arm of said first vent valve when said first end moves to said high limit, and said second high limit trip dog contacts said valve opening arm of said second vent valve when said second end moves to said high limit.

9. A manufacturing apparatus includes a supply roll that provides a web to the manufacturing apparatus, and wherein the web moves at a predetermined velocity over a cylindrical roller and subsequently into the apparatus, the web having tension unevenly distributed across its width upstream from the cylindrical roller, the improvement comprising:

fluid means for movably supporting the ends of the cylindrical roller in a direction substantially perpendicular to the direction of movement of the web; and said fluid means further being for adjusting the position of said cylindrical roller to redistribute the tension uniformly across the web, wherein said fluid means adjusting the cylindrical roller in response to a force applied by the moving web to a first end and a second end of said cylindrical roller.

10. The improvement of claim 9 wherein:

said fluid means for movably supporting is pneumatic.

11. The improvement of claim 10 wherein:

said roller has a first end and a second end;

said fluid means for movably supporting includes a first bracket attached to the apparatus and having a first bearing movably attached thereto and a second bracket attached to the apparatus and having a second bearing movably attached thereto, and includes a first pneumatic spring attached between said first bracket and said first bearing, and further includes a second pneumatic spring attached between said second bracket and said second bearing; and wherein said first end of said roller is supported by said first bearing and said second end of said roller is supported by said second bearing.

12. The improvement of claim 11 wherein:

said first pneumatic spring is in fluid communication with said second pneumatic spring to allow gas to shift therebetween, thereby coupling the movement of said first end of said roller to said second end of said roller.

* * * * *